US010627846B1

(12) United States Patent
Toubar et al.

(10) Patent No.: US 10,627,846 B1
(45) Date of Patent: Apr. 21, 2020

(54) METHOD AND APPARATUS FOR LOW-OUTPUT-NOISE, HIGH-POWER-SUPPLY-REJECTION AND HIGH-PRECISION TRIMMABLE BAND-GAP VOLTAGE REFERENCE SUITABLE FOR PRODUCTION TEST

(71) Applicant: Vidatronic Inc., College Station, TX (US)

(72) Inventors: Mostafa Mohamed Hesham Kamel Toubar, Cairo (EG); Anand Veeravalli Raghupathy, Plano, TX (US); Sameh Ahmed Assem Ibrahim, Cairo (EG)

(73) Assignee: Vidatronic, Inc., College Station, TX (US)

( * ) Notice: Subject to any disclaimer, the term of this patent is extended or adjusted under 35 U.S.C. 154(b) by 0 days.

(21) Appl. No.: 16/205,561

(22) Filed: Nov. 30, 2018

(51) Int. Cl.
*G05F 3/20* (2006.01)

(52) U.S. Cl.
CPC ..... *G05F 3/20* (2013.01)

(58) Field of Classification Search
CPC ..... G05F 3/20; G05F 3/08; G05F 3/16; G05F 3/22; G05F 3/225; G05F 3/30
See application file for complete search history.

(56) References Cited

U.S. PATENT DOCUMENTS

| | | | | |
|---|---|---|---|---|
| 9,013,231 | B1 * | 4/2015 | Manea | G05F 3/30 327/539 |
| 10,013,013 | B1 * | 7/2018 | Wortel | G05F 3/10 |
| 2014/0145691 | A1 * | 5/2014 | Nagda | G05F 1/10 323/271 |
| 2015/0338872 | A1 * | 11/2015 | Afzal | G05F 3/30 323/313 |
| 2017/0099011 | A1 * | 4/2017 | Freeman | H02M 7/06 |
| 2017/0160763 | A1 * | 6/2017 | Barbelenet | G05F 1/468 |
| 2018/0217622 | A1 * | 8/2018 | Shrivastava | G05F 1/468 |
| 2019/0064868 | A1 * | 2/2019 | Trifonov | G05F 3/30 |
| 2019/0140631 | A1 * | 5/2019 | Manohar | H03K 17/145 |

* cited by examiner

*Primary Examiner* — Yusef A Ahmed
*Assistant Examiner* — Shahzeb K Ahmad
(74) *Attorney, Agent, or Firm* — Liang Legal Group, PLLC

(57) ABSTRACT

A band-gap reference circuit includes a band-gap voltage reference core to provide a reference voltage; a low impedance block; three capacitors; two transmission gates to connect and disconnect the capacitors; and two digital control blocks. The three capacitors includes an output capacitor connected at an output of the low impedance block to ground; a small capacitor connected to an output of the band-gap voltage reference core; and a large capacitor connected to the two transmission gates. The band-gap voltage reference core includes an operational amplifier, wherein an output of the operational amplifier connects to an input of the low impedance block and the small capacitor, wherein the small capacitor is also connected to ground; and a combination of bipolar junction transistors, MOS-FET, resistors, capacitors, or FinFET devices that provides a reference voltage.

11 Claims, 6 Drawing Sheets

METHOD AND APPARATUS FOR LOW-OUTPUT-NOISE, HIGH-POWER-SUPPLY-REJECTION AND HIGH-PRECISION TRIMMABLE BAND-GAP VOLTAGE REFERENCE SUITABLE FOR PRODUCTION TEST

BACKGROUND

There is a growing trend of designing precision band-gap voltage reference circuits that are suitable for production test. Such circuits are always an essential component in massive digital, analog and mixed-signal circuits, as they provide precise reference voltages and/or reference currents, which have low sensitivity to power supply noise, temperature and process variations. In some cases, the reference currents may be inversely proportional to the value of a reference resistor.

Band-gap reference circuits provide reference voltages and/or reference currents. However, some band-gap circuits suffer from high temperature drifts and are unsuitable for high-precision applications. As a result, curvature trimming is an important and common post-fabrication step to achieve a low voltage drift over a range of temperatures, especially below 50 ppm/° C. In addition, a small start-up time is needed for efficient trimming during production test, because test time directly translates into chip cost. In contrast, large capacitors are typically needed to achieve low noise and high power supply rejection (PSR). However, such large capacitors would result in large start-up times, which are in conflict with the preferred requirements for test time. High-precision applications that require low output noise and high PSR from the band-gap reference output would require both small start-up times and large capacitors.

FIG. 1 shows a prior art band-gap voltage reference circuit (100) followed by a large resistor (101) and a large capacitor (102) forming an RC filter to reject high-frequency noises, thereby achieving low output noise and high PSR. As a result, the start-up time is large because the start-up time is proportional to the RC time constant.

FIG. 2 shows a prior art band-gap voltage reference circuit (200). The circuit consists of a conventional band-gap circuit made of two bipolar junction transistors $Q_1$ (201) and $Q_2$ (202), a resistor $R_1$ (203) and two $R_2$ resistors (204) and (205), an operational amplifier (206), two MOSFET current sources $M_1$ (207) and $M_2$ (208), and an output branch consisting of a MOSFET current source $M_3$ (209) and a resistor $R_3$ (210). The current flowing in the bipolar transistors $Q_1$ (201) and $Q_2$ (202) is proportional to absolute temperature (PTAT), while the current flowing in the $R_2$ resistors (204) and (205) is complementary to absolute temperature (CTAT). As a result, the current in the MOSFET current sources $M_1$ (207), $M_2$ (208) and $M_3$ (209) is almost independent of absolute temperature. However, due to the non-linear temperature dependence of the CTAT current that originates from the temperature dependence of the bipolar junction forward voltage, the reference voltage shows temperature dependence that is usually not acceptable in high-precision application.

To control the undesirable temperature dependence, the band-gap reference circuit (200) uses a bipolar junction transistor $Q_3$ (211), two $R_4$ resistors (212 and 213), and a MOSFET current source $M_4$ (214) to subtract the non-linear temperature dependence of the CTAT currents, thereby yielding an almost constant reference with respect to temperature variations. In this design, there is no filter or capacitor to limit the bandwidth of the band-gap. Therefore, the start-up time will be small and suitable for production test. However, the PSR will be low and the noise will be high for this design.

Thus, the prior art band-gap reference circuit disclosed in FIG. 1 uses either a filter or large output capacitor to limit the bandwidth and get high PSR and low output noise. Such a band-gap reference circuit has a large start-up time and cannot be used in high-precision applications as it will require a large trimming time during production test. The band-gap reference circuit disclosed in FIG. 2 has a low sensitivity to temperature variations and a small start-up time suitable for production test. However, this prior art band-gap reference circuit has poor PSR and high output noise due to the lack of large capacitors and/or RC filters.

While these prior art band-gap reference circuits are useful, there is still a need in the semiconductor industry for band-gap reference circuits that satisfy the requirements for high precision applications (e.g. low temperature sensitivity, high PSR and low output noise) while also having a fast start-up time to support production test.

SUMMARY

Embodiments of the invention relate to novel bandgap reference circuits/architectures to provide bandgap voltage references with low output noises, low sensitivities to temperature variations and high PSR, making them suitable for high-precision applications while simultaneously satisfying the requirements of low production test/trimming times.

One aspect of the invention relates to band-gap reference circuits. A band-gap reference circuit in accordance with one embodiment of the invention includes a band-gap voltage reference core to provide a reference voltage; a low impedance block; three capacitors; two transmission gates to connect and disconnect the capacitors; and two digital control blocks. The three capacitors include an output capacitor connected at an output of the low impedance block to ground; a small capacitor connected to an output of the band-gap voltage reference core; and a large capacitor connected to the two transmission gates.

The band-gap voltage reference core includes an operational amplifier, wherein an output of the operational amplifier connects to an input of the low impedance block and the small capacitor, wherein the small capacitor is also connected to ground; and a combination of bipolar junction transistors, MOS-FET, resistors, capacitors, or FinFET devices that provides a reference voltage.

The two transmission gates include a first switch that either connects or disconnects the large capacitor to the output and ground, and a second switch that either connects or disconnects the large capacitor to the output capacitor and ground, depending on the control signal indicating the trim mode or the mission mode.

The two digital control blocks comprise a BG_OK block connected at an output of the large capacitor, which is connected with an output of the low impedance block, to generate a BG_OK signal to a control block; and the control block connected to gates of the two transmission gates.

The low impedance block comprises a source follower, built with an LVT NMOS transistor or a combination of MOSFETs, that results in a low output impedance.

Another aspect of the invention relates to methods for trimming and operating a band-gap reference circuit. A method in accordance with one embodiment of the invention comprises the steps of: disconnecting a large capacitor in the band-gap reference circuit to achieve a small start-up time; trimming the band-gap reference circuit; pre-charging the large capacitor; connecting the large capacitor to enable stable performance of the band-gap reference circuit; and switching the band-gap reference circuit in mission mode.

Other aspects of the invention would become apparent with the following description and the accompanying drawings.

BRIEF DESCRIPTION OF DRAWINGS

The appended drawings illustrate several embodiments of the invention and are not to be considered limiting of its scope, for the invention may admit to other equally effective embodiments.

DETAILED DESCRIPTION

Figure 1:
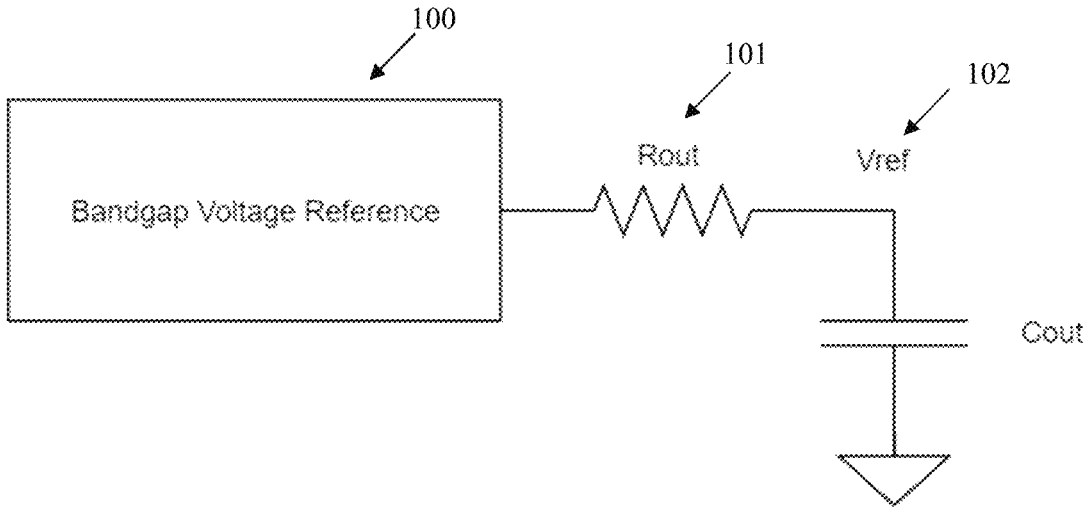
Fig. 1 (Prior Art)
FIG. 1 shows a block diagram of a prior art band-gap reference circuit with an RC filter.

Aspects of the present disclosure are shown in the above drawings and are described below. In the description, like or identical reference numerals are used to identify common or similar elements. The drawings are not necessarily to scales, and certain features may be shown exaggerated in scale or in schematic in the interest of clarity and conciseness.

Embodiments of the invention relate to band-gap reference circuits. A band-gap reference circuit of the invention has high-order temperature curvature compensation, low output impedance for driving capability, low output noise, high PSR, and small start-up time during trimming for production test.

In accordance with embodiments of the invention, a transconductance amplifier may be used to provide three currents with low dependence on temperature to improve the temperature dependency of the output voltage. In one or more embodiments of the invention, an operational amplifier followed by a low output impedance block may be used to reduce the overall output impedance of the band-gap reference circuit, thus providing output current via the reference output.

In one or more embodiments of the invention, a transmission gate controlled with a control signal (ate_c) from a control block may be used to connect a large on-die capacitor with a small on-die capacitor. The transmission gate may be controlled in such a manner that the large capacitor is disconnected during trim/test mode to speed-up the circuit, while the large capacitor may be connected during regular mission mode to achieve high analog performance. With these programmable modes, the same silicon may satisfy both purposes: a small test time and high analog performance.

Without embodiments of the invention, a band-gap reference circuit may have either a large start-up time not suitable for trimming or high output noise and low PSR, which are not suitable for high-precision applications. Those skilled in the art, with the benefit of this disclosure will appreciate that same or similar features are equally applicable to any trimmable system whose operation requires high PSR and low output noise.

In one or more embodiments, a transmission gate controlled with a control signal (precharge_c) from the control block may be used to connect a large on-die capacitor with the output on-die capacitor. The control signals for the switch over also contain an option for this switching to happen automatically, using the information from the BG_OK signal which indicates that the band-gap is up. A motivation for such a feature could be low start-up time requirements, even in "mission mode", while still maintaining high performance, once start-up is completed.

In one or more embodiments, the band-gap reference circuit can be implemented on a microchip, such as a semiconductor integrated circuit or can be implemented out of discrete components. In one or more embodiments, the band-gap reference circuit can use an output capacitor or not. Throughout this disclosure, the terms "band-gap circuit," "band-gap reference circuit," and "voltage reference" may be used interchangeably depending on the context.

Figure 3:
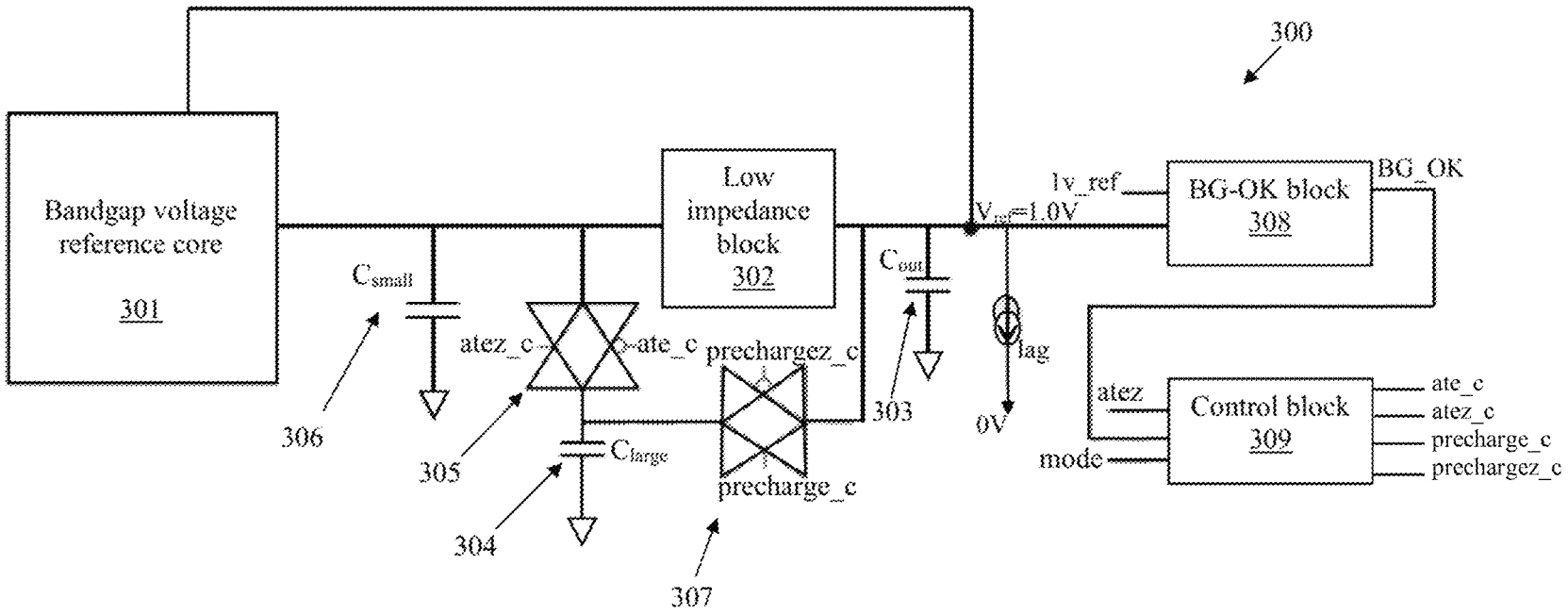
FIG. 3 shows a block diagram of a band-gap reference circuit connected to a low output impedance block with low output noise, high PSR, and a small start-up time for fast trimming, in accordance with one embodiment of the invention.

FIG. 3 shows a block diagram of a band-gap reference circuit (300) in accordance with one embodiment of the invention. The band-gap reference circuit (300) has low output noise, high PSR, and small start-up time for efficient trimming during production test. As shown in FIG. 3, the band-gap reference circuit (300) comprises a band-gap voltage reference core (301), a low output impedance block (302) with an output capacitor $C_{ont}$ (303) for high PSR and switching, a large capacitor $C_{large}$ (304) for low noise, wherein the large capacitor $C_{large}$ (304) can be connected or disconnected with trimming a control signal (ate_c) to make the transmission gate/switch (305) open or closed, and a small capacitor $C_{small}$ (306) connected at all times for system stability.

Figure 2:
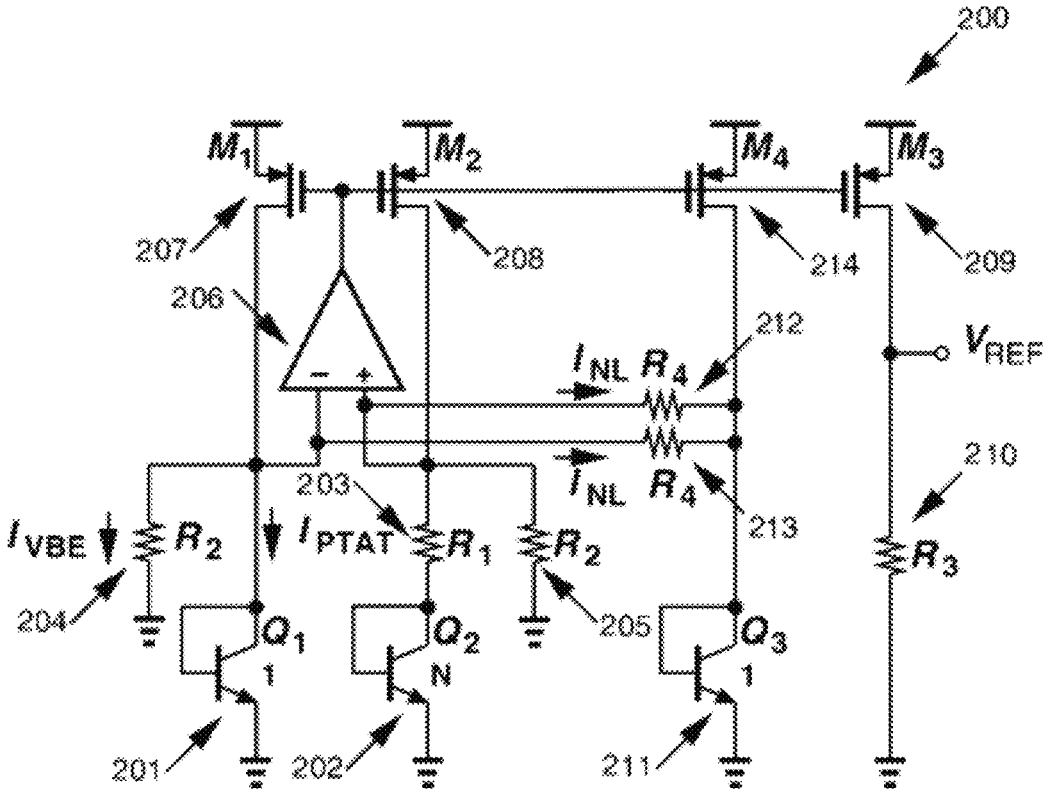
Fig. 2 (Prior Art)
FIG. 2 shows a schematic block level circuit diagram of a prior art band-gap reference circuit with high-order temperature curvature compensation, but without an RC filter or output capacitor.

As compared with a prior art band-gap reference circuit (such as that shown in FIG. 2), band-gap reference circuits of the invention (such as that shown in FIG. 3) have several novel features that allow the band-gap reference circuits to have low output noise, high PSR, and small start-up time for efficient trimming during production test while maintaining outstanding analog performance during operations. Such novel features, for example, include having a low output impedance block (302) to provide support for an output current or a high leakage current and having switches (transmission gates) that connect and disconnect a large capacitor such that a short settling time is possible while maintaining good analog performance during operations.

To control the switches, the band-gap reference circuit (300) may use a BG_OK block (308) to generate a logic high signal (BG_OK) when the band-gap is up and a control block (309) to generate the control signals for the switching. For example, the control block (309) may send a control signal to the transmission gate (305) to connect the large capacitor $C_{large}$ (304) when the system is in the mission mode, or send a control signal to the transmission gate (305) to disconnect the large capacitor $C_{large}$ (304) when the system is in the test/trim mode. In addition, the control block (309) may send signals to a second transmission gate (307), which may be referred to as a switch (307), to pre-charge the large capacitor $Cr_{large}$ (304) in the mission mode to avoid a large voltage drop at the output when capacitor $Cr_{large}$ (304) is re-connected.

As shown in FIG. 3, the BG_OK block (308) may be connected at the output of the large capacitor (in the nF range; 304), which is connected at the output of the low impedance block (302). The BG_OK block (308) may generate a BG_OK signal to the control block (309) to indicate that the system is in the mission mode. The control block (309) may be connected to the gates of the transmission gate (305) and/or switch (307) to control these gates/switches, which will connect or disconnect the large capacitor $C_{large}$ (304). When the system is in the test or trim mode, the large capacitor (304) is disconnected to reduce the settling or startup time. When the system is in the mission mode, the large capacitor $Cr_{large}$ (304) is connected to provide good analog performance. If it is desired, the system may have an automatic switch over, even in the "mission mode" using the BG_OK signal that indicates that the band gap is up. This switching network serves to reduce output settling/start-up time, without sacrificing analog performance in steady state "mission mode."

The second transmission gate/switch (307) can be used to connect or disconnect the large capacitor to the output capacitor (303) and ground, depending on a control signal indicating the trim mode or the mission mode. The second transmission gate/switch (307) may be used to pre-charge the large capacitor $Cr_{large}$ (304) in the mission mode to avoid a large voltage drop at the output when capacitor $Cr_{large}$ (304) is re-connected. If it is desired, an automatic switch over may be performed, even in the "mission mode" using the BG_OK signal that indicates that the band gap is up.

In this description, a large capacitor $C_{large}$ is a capacitor having a capacitance in the nF range (e.g., 1-1000 nF, preferably 10-100 nF), while a small capacitor $C_{small}$ is a capacitor having a capacitance in the pF range (e.g., 1-1000 pF, preferably 10-100 pF).

The specific blocks in FIG. 3 may be implemented with various suitable circuits. The following will describe some exemplary implementations for each block. One skilled in the art would appreciate that these specific examples are for illustration only and other modifications and variations may be possible without departing from the scope of the invention.

Figure 4:
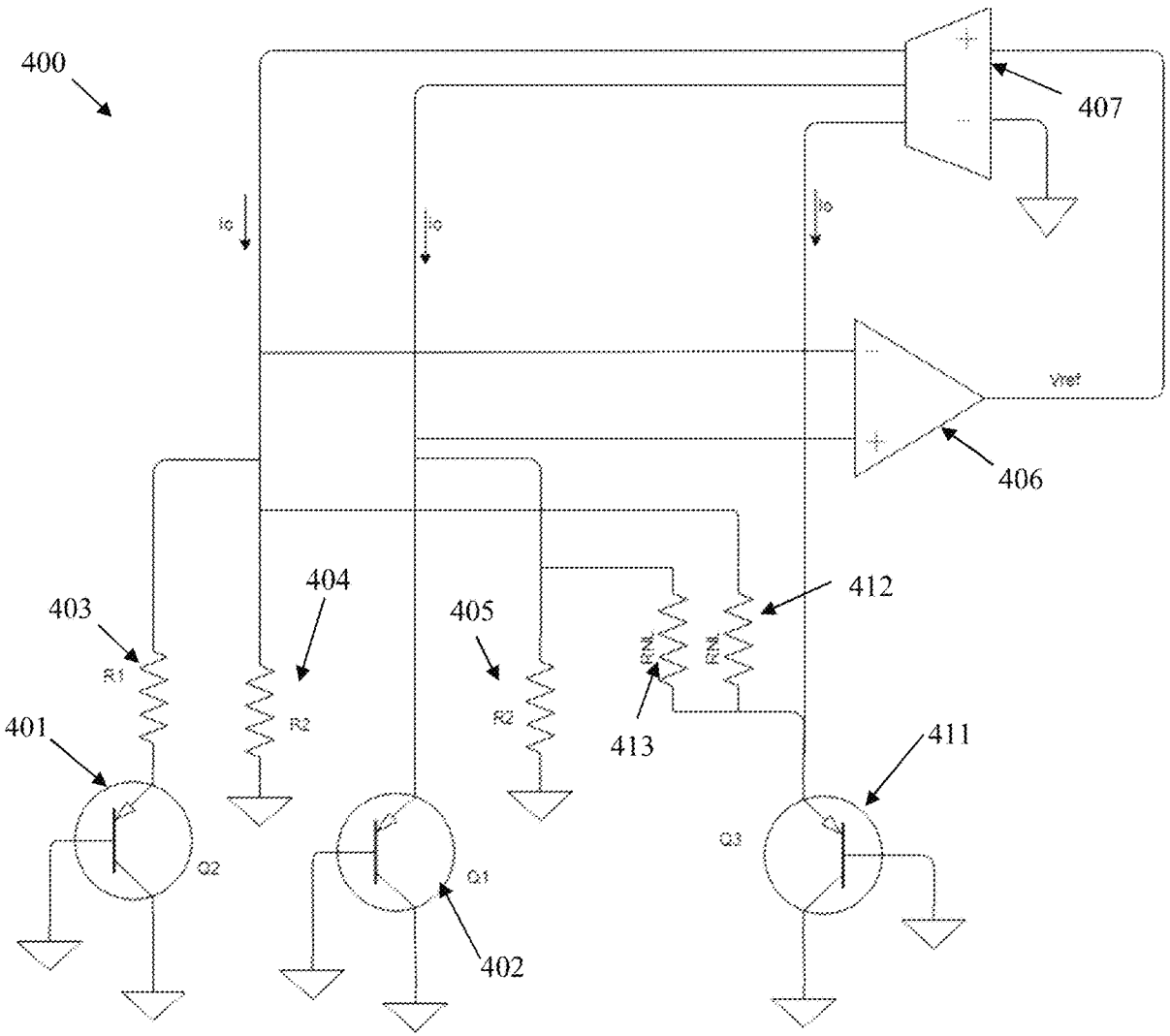
FIG. 4 shows an example circuit diagram of a band-gap reference circuit with high-order temperature curvature compensation, in accordance with one embodiment of the invention.

FIG. 4 shows a possible implementation of a band-gap reference core (301) of FIG. 3 with a high-order temperature curvature compensation. In this example, the band-gap reference core (301) comprises a conventional band-gap circuit made of two bipolar junction transistors $Q_1$ (401) and $Q_2$ (402), three resistors $R_1$ (403) and $R_2$ (404 and 405), an operational amplifier (406), and a transconductance amplifier (407). The transconductance amplifier (407) produces three currents that have very low dependency on temperature variations. Two of the currents are used for $Q_1$ (401) and $Q_2$ (402) in the conventional band-gap circuit, while the third is used for the third bipolar junction transistor $Q_3$ (411). The bipolar junction transistor $Q_3$ (411) and two $R_{NL}$ resistors (412) and (413) are used to cancel the non-linear temperature dependence of the CTAT currents flowing in the $R_2$ resistors (404) and (405), yielding an almost constant current and voltage reference with temperature. The transconductance amplifier (407) should have a linear relationship between its input voltage and output currents, which have very small dependence on temperature variations.

The operational amplifier (406) may be implemented as a single or two-stage amplifier, a folded-cascode, or a telescope cascode amplifier, has a low output impedance or high output impedance, and inputs can be PMOS or NMOS or PNP or NPN or FinFET devices.

FIG. 4 shows one example of a band-gap voltage reference core implementation. One skilled in the art would appreciate that other suitable implementations are possible. For example, a band-gap reference voltage reference core (301) may be a conventional band-gap circuit, which is directly connected to an operational amplifier or through a resistor divider. The band-gap reference voltage reference core (301) as a reference generator may use a combination of bipolar junction transistors, MOS-FET, resistors, capacitors, or FinFET devices that can provide a reference voltage.

The operational amplifier can be implemented as a single or two-stage amplifier, a folded-cascode, or a telescope cascode amplifier, has a low output impedance or high output impedance, and inputs can be PMOS or NMOS or PNP or NPN or FinFET devices. The conventional band-gap circuit can be directly connected to the operational amplifier or through a resistor divider. The resistors can be silicided poly, un-silicided poly, diffusion, or well resistors, or a combination thereof.

Figure 5:
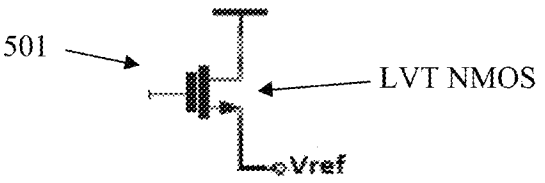
FIG. 5 shows an example circuit diagram of a low impedance block that can be used in the band-gap reference circuit, in accordance with one embodiment of the invention.

FIG. 5 shows a possible implementation of the low impedance block (305) of FIG. 3. In this example, the low impedance block (305) is implemented as a source follower LVT (Low Vt) NMOS transistor (501) that can provide low impedance at the output node and can also provide any necessary load/leakage current. The low impedance block can be a source follower built using any other suitable combination of MOSFETs that results in a low output impedance.

Figure 6:
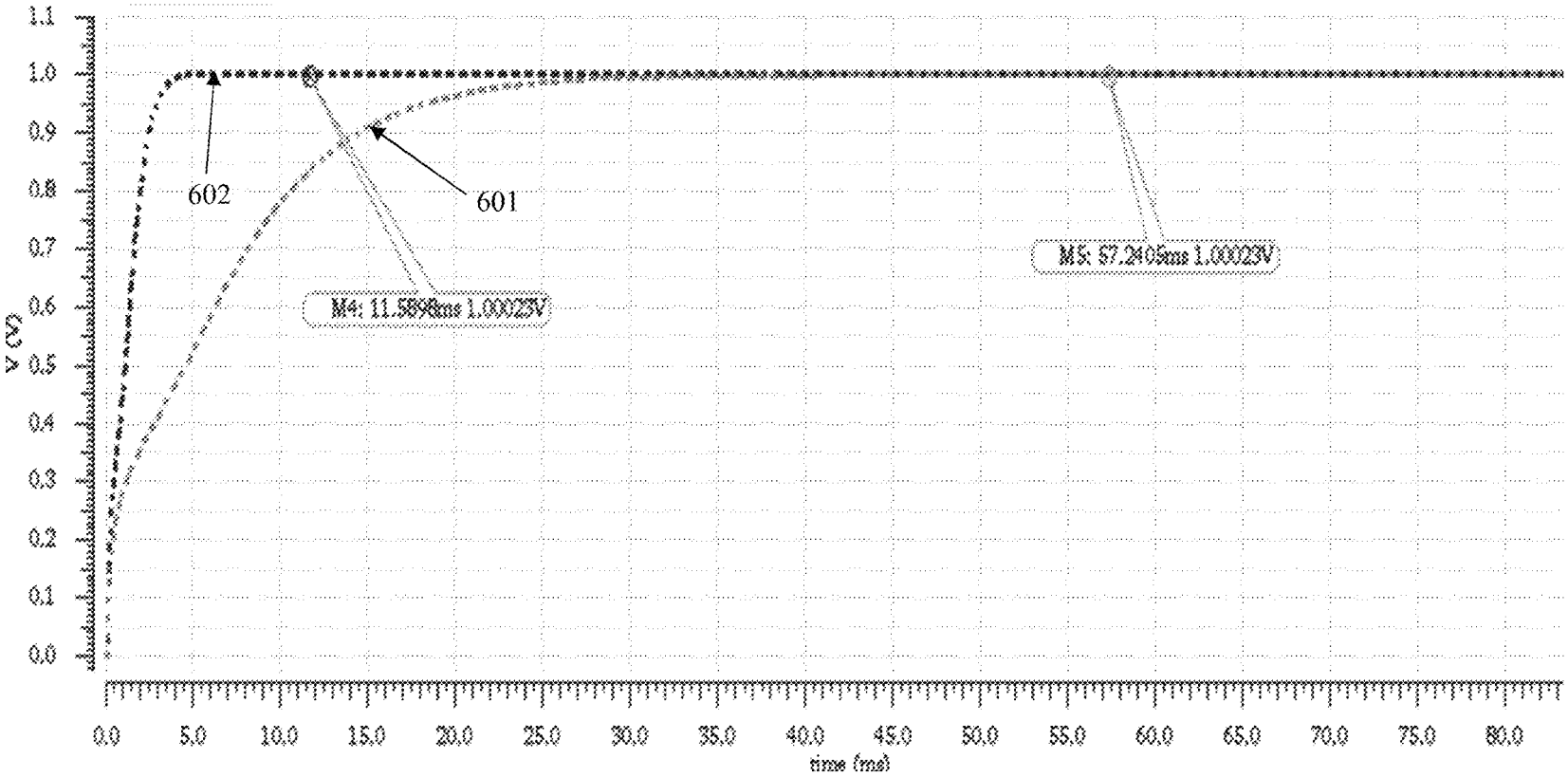
FIG. 6 shows the simulated output voltage of a band-gap reference during trimming when the trimming control signal=1 (logic high) and after trimming when the trimming control signal=0 (logic low).

FIG. 6 shows the simulated output voltages of the band-gap reference circuit (300) of FIG. 3 during trimming, when the trimming control signal (ate)=1 (logic high), and after trimming, when ate=0 (logic low). Simulations are performed while an output load current is being drawn out of the circuit. Plot (601) shows an output voltage when ate=0 (logic low). The long start-up time as shown on plot (601) may not be suitable for some high-precision applications that require a trimmable band-gap voltage reference. Plot (602) shows the same output voltage when ate=1 (logic high). In this mode, the large capacitor (304) is disconnected by turning off the transmission gate (305), and as a result, a small start-up time of 11.6 ms is observed, which is better for trimming a tester, instead of 57.3 ms when the large capacitor $C_{large}$ (304) is connected.

Figure 7:
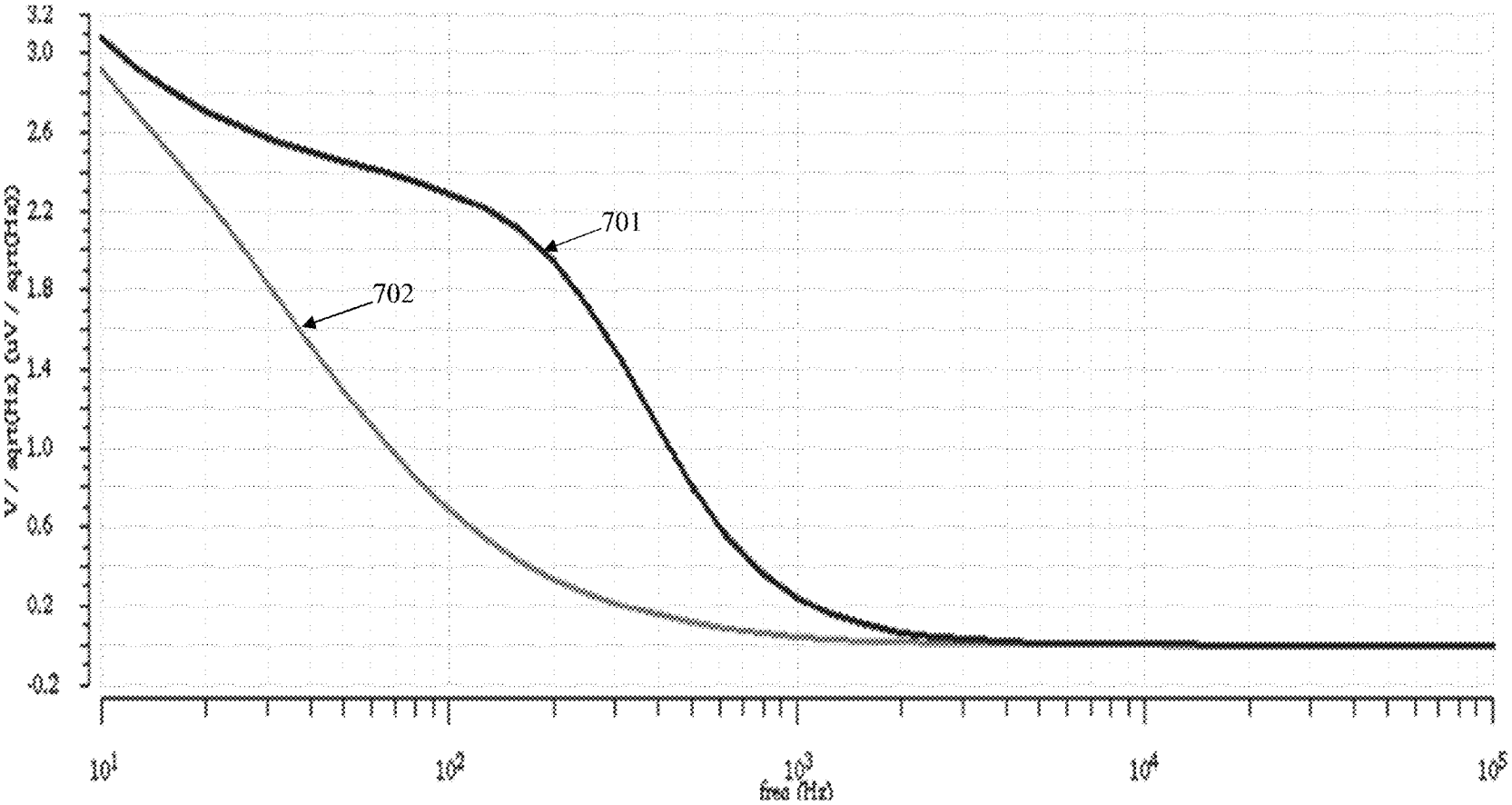
FIG. 7 shows the simulated output noise of a band-gap reference during trimming when the trimming control signal=1 (logic high) and after trimming when the trimming control signal=0 (logic low).

FIG. 7 shows the simulated output noises of the band-gap reference circuit (300) of FIG. 3 during trimming when ate=1 (logic high) and after trimming when ate=0 (logic low). Simulations are performed while an output load current is being drawn out of the circuit. Plot (701) shows the output noise when ate=1 (logic high). This may not be suitable for some low-output-noise applications that require low-noise band-gap voltage reference. Plot (702) shows the output noise when ate signal=0 (logic low). This turns the transmission gate (305) on connecting the large capacitor (304) after the trimming is done and as a result, an integrated output noise of 15.5 μV integrated from 10 Hz to 100 KHz (plot 702) is observed instead of 41.2 μV (plot 701) when the large capacitor $C_{large}$ (304) is disconnected.

As shown in FIG. 6, a band-gap reference circuit of the invention can achieve short start-up time (by disconnecting the large capacitor). As shown in FIG. 7, after trimming, the large capacitor can be connected to achieve the good analog performance.

Figure 8:
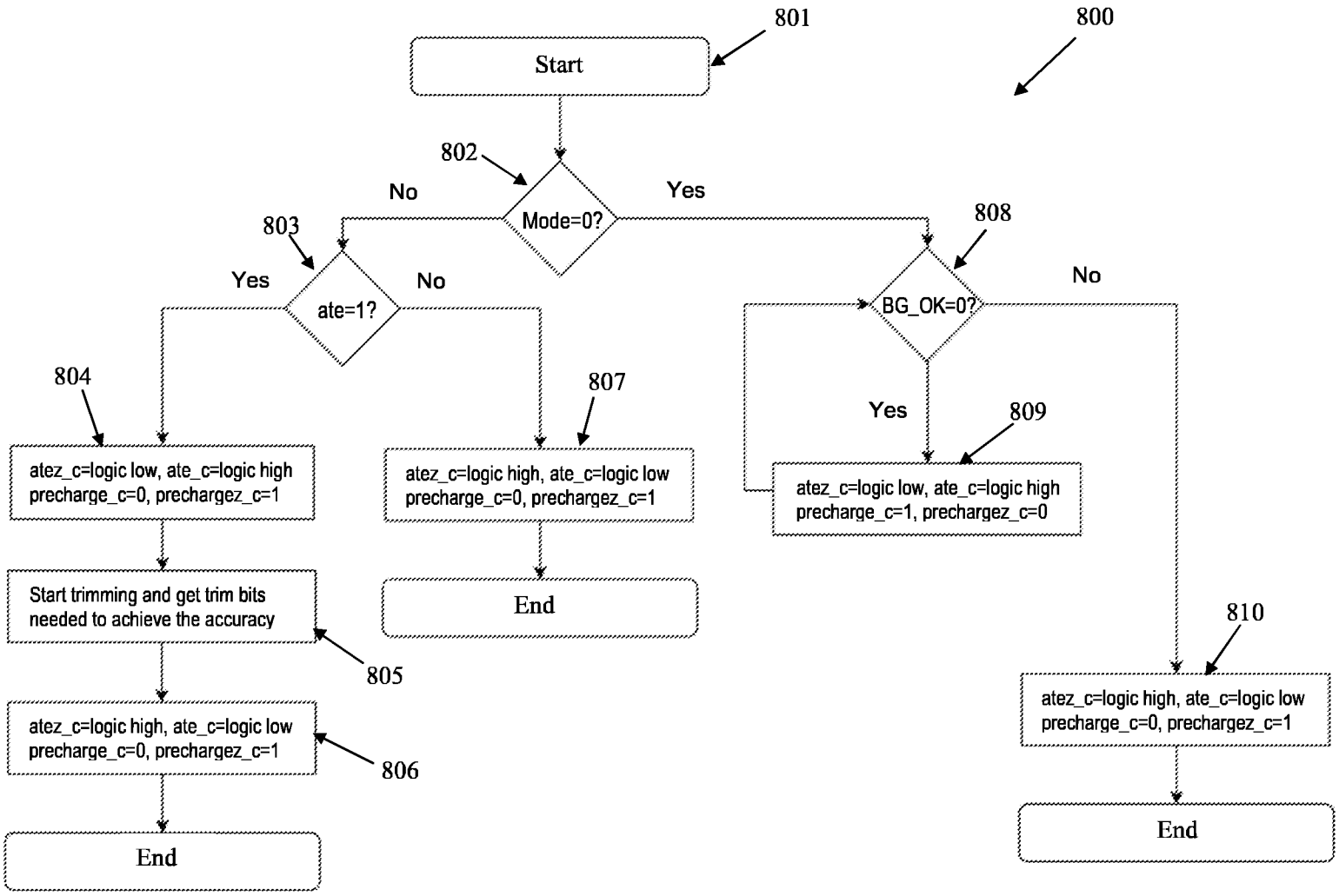
FIG. 8 illustrates a simplified example flowchart for a method of trimming the voltage reference circuit.

FIG. 8 shows a simplified flowchart (800) of an example of a method for trimming the voltage reference circuit, such as the band-gap voltage reference circuit (300). The method starts at (801) and moves on to (802) where if mode=0, mission mode is selected, and the flowchart moves on to (808), where if BG_OK is set to a logic low, the flowchart moves on to (809).

At (809), (i) trimming control signal (ate_c) is set to a logic high and atez_c is set to a logic low to disconnect the large capacitor $C_{large}$ (304), (ii) pre-charge control signal (precharge_c) is set to a logic high and pre-chargez_c is set to a logic low to pre-charge the capacitor $C_{large}$ (304) to avoid a large output voltage drop when capacitor $Cr_{large}$ (304) is re-connected, and (iii) until BG_OK is a logic high then it moves on to (810).

At (810), (i) the trimming control signal (ate_c) is set to a logic low and atez_c is set to a logic high to connect the large capacitor $C_{large}$ (304) to achieve the required performance, and (ii) pre-charge control signal (precharge_c) is set to a logic low and pre-chargez_c is set to a logic high.

If the mode is a logic high, then the flowchart moves on to (803), where if trimming signal (ate) is a logic high, then the trimming mode (804) is selected. At (804), (i) the trimming control signal (ate_c) is set to a logic high and (atez_c) is set to a logic low to disconnect the large capacitor $C_{large}$ (304), (ii) pre-charge control signal (precharge_c) is set to a logic low and (pre-chargez_c) is set to a logic high because there is no need to connect the large capacitor $C_{large}$ (304) while performing the trimming operation.

Next, at (805) trimming should start to get the trimming bits values needed to achieve the required accuracy and after getting these bits, at (806) the trimming control signal (ate_c) is set to a logic low and (atez_c) is set to a logic high to re-connect the large capacitor (304) to achieve the required performance.

At (803), if trimming signal is a logic low (ate=0), then move to (807) where (i) the trimming control signal (ate_c) is set to a logic low and (atez_c) is set to a logic high to connect the large capacitor $C_{large}$ (304), and (ii) pre-charge control signal (precharge_c) is set to a logic low and pre-chargez_c is set to a logic high.

While the invention has been described with respect to a limited number of embodiments, those skilled in the art, having the benefit of this disclosure, will appreciate that other embodiments can be devised which do not depart from the scope of the invention as disclosed herein. Accordingly, the scope of the invention should be limited only by the attached claims.

What is claimed is:

1. A band-gap reference circuit, comprising:

a band-gap voltage reference core to provide a reference voltage;

a low impedance block, wherein an input of the low impedance block is connected to an output of the band-gap voltage reference core;

an output capacitor connected to an output of the low impedance block;

a small capacitor connected to the output of the band-gap voltage reference core;

a large capacitor connected, via a first transmission gate, to the output of the band-gap voltage reference core, and, via a second transmission gate, to the output of the low impedance block and the output capacitor;

a band-gap status block connected to the output of the low impedance block and configured to generate a mode signal indicating a trim mode or a mission mode;

and a digital control block connected to an output of the band-gap status block and to the first transmission gate and the second transmission gate, wherein the digital control block is configured to generate a control signal to the first transmission gate and/or the second transmission gate.

2. The band-gap reference circuit of claim 1, wherein the band-gap voltage reference core comprises:

an operational amplifier, wherein an output of the operational amplifier connects to an input of the low impedance block and the small capacitor, wherein the small capacitor is also connected to ground; and a combination of bipolar junction transistors, MOS-FET, resistors, capacitors, or FinFET devices that provides the reference voltage.

3. The band-gap reference circuit of claim 1, wherein the first transmission gate comprises a first switch that either connects or disconnects the large capacitor to the output of the band-gap voltage reference core and ground, depending on the control signal indicating the trim mode or the mission mode; and the second transmission gate comprises a second switch that either connects or disconnects the large capacitor to the output capacitor and ground, depending on the control signal indicating the trim mode or the mission mode.

4. The band-gap reference circuit of claim 1, wherein the band-gap voltage reference core comprises:

an operational amplifier, which comprises a single or two-stage amplifier, a folded-cascode, or a telescope cascode amplifier, wherein inputs of the operational amplifier connect with PMOS or NMOS or PNP or NPN or FinFET devices.

5. The band-gap reference circuit of claim 1, wherein the band-gap voltage reference core comprises:

a reference generator, which uses bipolar junction transistors, MOS-FET, or FinFET devices.

6. The band-gap reference circuit of claim 1, wherein the band-gap voltage reference core comprises:

a conventional band-gap circuit, which is directly connected to an operational amplifier or through a resistor divider.

7. The band-gap reference circuit of claim 6, wherein the resistor divider comprises:

resistors that are silicided poly resistors, un-silicided poly resistors, diffusion resistors, or well resistors, or a combination thereof.

8. The band-gap reference circuit of claim 1, wherein the output capacitor, the small capacitor, and the large capacitor each are independently a MOS capacitor, an MIM capacitor, or an MOM capacitor.

9. The band-gap reference circuit of claim 1, wherein the low impedance block comprises: a source follower, built with an LVT NMOS transistor or a combination of MOS-FETs, that results in a low output impedance.

10. The band-gap reference circuit of claim 1, wherein the transmission gates comprise: control switches made of an NMOS transistor, a PMOS transistor, or a combination thereof.

11. A method for trimming and operating a band-gap reference circuit, which comprises a band-gap voltage reference core to provide a reference voltage; a low impedance block, wherein an input of the low impedance block is connected to an output of the band-gap voltage reference core; an output capacitor connected to an output of the low impedance block; a small capacitor connected to the output of the band-gap voltage reference core; a large capacitor connected, via a first transmission gate, to the output of the band-gap voltage reference core, and, via a second transmission gate, to the output of the low impedance block and the output capacitor; a band-gap status block connected to the output of the low impedance block and configured to generate a mode signal indicating a trim mode or a mission mode; and a digital control block connected to an output of the band-gap status block and to the first transmission gate and the second transmission gate, wherein the digital control block is configured to generate a control signal to the first transmission gate and/or the second transmission gate, the method comprising:

disconnecting the large capacitor in the band-gap reference circuit to achieve a small start-up time in the trim mode;

trimming the band-gap reference circuit;

pre-charging the large capacitor;

connecting the large capacitor to enable stable performance of the band-gap reference circuit; and switching the band-gap reference circuit in the mission mode.

* * * * *